US006160976A

United States Patent [19]

Karakama et al.

[11] Patent Number: 6,160,976

[45] **Date of Patent: *Dec. 12, 2000**

[54] DEVELOPING DEVICE HAVING MAGNETIC SEALS

[75] Inventors: Toshiyuki Karakama, Tokyo; Isao Ikemoto, Kashiwa; Kazushi Watanabe, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,960

[22] Filed: Jul. 18, 1997

[30] Foreign Application Priority Data

Jul. 26, 1996 [JP] Japan ..... 8-198152

[51] Int. Cl.[7] ..... G03G 15/08

[52] U.S. Cl. ..... 399/104

[58] Field of Search ..... 399/102–106

[56] References Cited

U.S. PATENT DOCUMENTS 5,187,326 2/1993 Shirai .
5,475,470 12/1995 Sasago et al. .
5,543,898 8/1996 Shishido et al. .
5,563,689 10/1996 Tompkins et al. ..... 399/272
5,585,895 12/1996 Yashiro et al. .

FOREIGN PATENT DOCUMENTS 0723211 7/1996 European Pat. Off. .
61-172173 8/1986 Japan .
3-13977 1/1991 Japan .
7-168449 7/1995 Japan .

*Primary Examiner*—William J. Royer
*Attorney, Agent, or Firm*—Fitzpatrick, Cella, Harper & Scinto

[57] ABSTRACT

A developing device includes a developer container containing magnetic particles; a developer holding unit formed at an opening portion of the developer container, the developer holding unit rotating while holding a developer; a magnetic field generating unit placed in the developer holding unit; a magnet placed along a circumferential direction of the developer holding unit to form a magnetic seal between the magnet and the developer holding unit; and a magnetic unit placed to be adjacent to the magnet. The developing device attains a reduction in driving torque and a high magnetic sealing performance.

30 Claims, 10 Drawing Sheets

6
5
26
25
25
9
9
Y
21
22
23
24

PRIOR ART

DEVELOPING DEVICE HAVING MAGNETIC SEALS

BACKGROUND OF THE INVENTION

1. Field of the Invention

The present invention relates to a developing device used in an image forming apparatus of an electrophotographic or electrostatic recording scheme to develop an electrostatic image on an image holding member.

2. Description of the Related Art

In an image forming apparatus of the electrophotographic scheme, an electrostatic image formed on the photosensitive member is developed with toner in the developing device.

In such a developing device, a developer is held by the developing sleeve placed so as to oppose the photosensitive member in order to perform developing. So, toner must be prevented from leaking out via the end portions of the developing sleeve.

To do this, seal members are provided for the developing sleeve end portions. As such a seal member for preventing leakage of toner, an elastic member, such as a felt or foam rubber member has widely been used. FIGS. 9 and 10 show a typical example of this member. FIG. 9 is a sectional front view showing the main part of a developing device. FIG. 10 is a sectional side view showing the main part of the developing device.

As shown in FIG. 9, a developing sleeve 5 incorporates a magnetic roller 6. The developing sleeve 5 is rotatably supported on a developer container 3 through a sleeve bearing 12, as shown in FIG. 10. With this arrangement, toner supplied from the developer container 3 adheres to the surface of the developing sleeve 5 owing to the magnetic force of the magnetic roller 6, and is regulated by a developing blade 7 to a predetermined thickness. Then, with rotation of the developing sleeve 5, the toner adheres to a latent image on the photosensitive drum 1 at a position opposite thereto, thus developing the image. Elastic seal members 8 are mounted on the two longitudinal end portions of the developing sleeve 5 outside the developing area. More specifically, the elastic seal members 8 are mounted on the front portion (on the opening side) of the developing sleeve 5, which is mounted on the developer container 3, and the rear portion (on the opposite side to the opening side) of the developing sleeve 5. These elastic seal members 8 are pressed against the outer surface of the developing sleeve 5 to prevent leakage of the toner.

In this sealing method of pressing the elastic members against the developing sleeve, the torque required to drive the developing sleeve during a developing operation becomes large.

In addition, as the number of times the elastic seal members are used increases, the sealing ability of each seal member deteriorates.

The sealing method of pressing the elastic members against the developing sleeve is not suitable for a developing device to realize a higher operation speed and a longer service life.

Under the circumstances, a technique of forming magnetic seals has been proposed. According to this technique, magnets are arranged at the two ends of a developing sleeve through a gap, and magnetic seals are formed by the magnetic fields generated by the magnets outside the developing sleeve and the magnet inside the developing sleeve.

FIG. 11 is a sectional front view showing an example of a developing device using magnetic seal members. Referring to FIG. 11, magnetic seal members 20, made of magnets, are wound around the two end portions of a developing sleeve 5 to oppose its outer surface through a predetermined gap g. In this state, the magnetic seal members 20 are mounted on a developer container 3, together with the developing sleeve 5. Each magnetic seal member 20 is magnetized to a magnetic pole pattern like the one shown in FIG. 12. The gap g between the outer surface of the developing sleeve 5 and the surface of each magnetic seal member 20 is filled with a magnetic brush due to a triboelectric brush of the toner formed along magnetic lines of force 24, thereby preventing the toner from leaking out of the developing area.

As a magnetic seal member, a member having the magnetization pattern shown in FIG. 13 or 14 may be used.

With the use of this technical means, since the developing sleeve 5 and the magnetic seal members 20 can be arranged in a non-contact state, the rotational torque of the developing sleeve 5 is considerably small. For this reason, a compact, inexpensive driving motor can be used. In addition, since variations in rotational torque are small, the developing sleeve 5 and the photosensitive drum 1 do not easily undergo rotation variations. This technique is therefore suitably used to increase the operation speed of the device.

Furthermore, since the magnetic seal members 20 are free from wear and the like, they can be used semipermanently and recycled.

In this magnetic sealing method, the sealing performance is influenced by the magnetic flux density.

Although the sealing effect can be enhanced by using magnets having strong magnetic forces, the device increases in size, and the magnetic forces may inflict adverse effects on the developing area.

SUMMARY OF THE INVENTION

It is an object of the present invention to provide a developing device which attains a reduction in driving torque for a developer holding member.

It is another object of the present invention to provide a developing device which can obtain a high magnetic sealing performance.

It is still another object of the present invention to provide a developing device comprising:

- a developer container containing magnetic particles;
- a developer holding member formed at an opening portion of the developer container, the developer holding member rotating while holding a developer;
- a magnetic field generating member placed in the developer holding member;
- a magnet placed along a circumferential direction of the developer holding member to form a magnetic seal in cooperation with the magnetic field generating member; and
- a magnetic member placed so as to be adjacent to the magnet.

The above and other objects, features, and advantages of the present invention will be apparent from the following detailed description in conjunction with the accompanying drawings and the appended claims.

DETAILED DESCRIPTION OF THE PREFERRED EMBODIMENTS

The embodiments of the present invention will be described below with reference to the accompanying drawings.

<First Embodiment>

Figure 1:
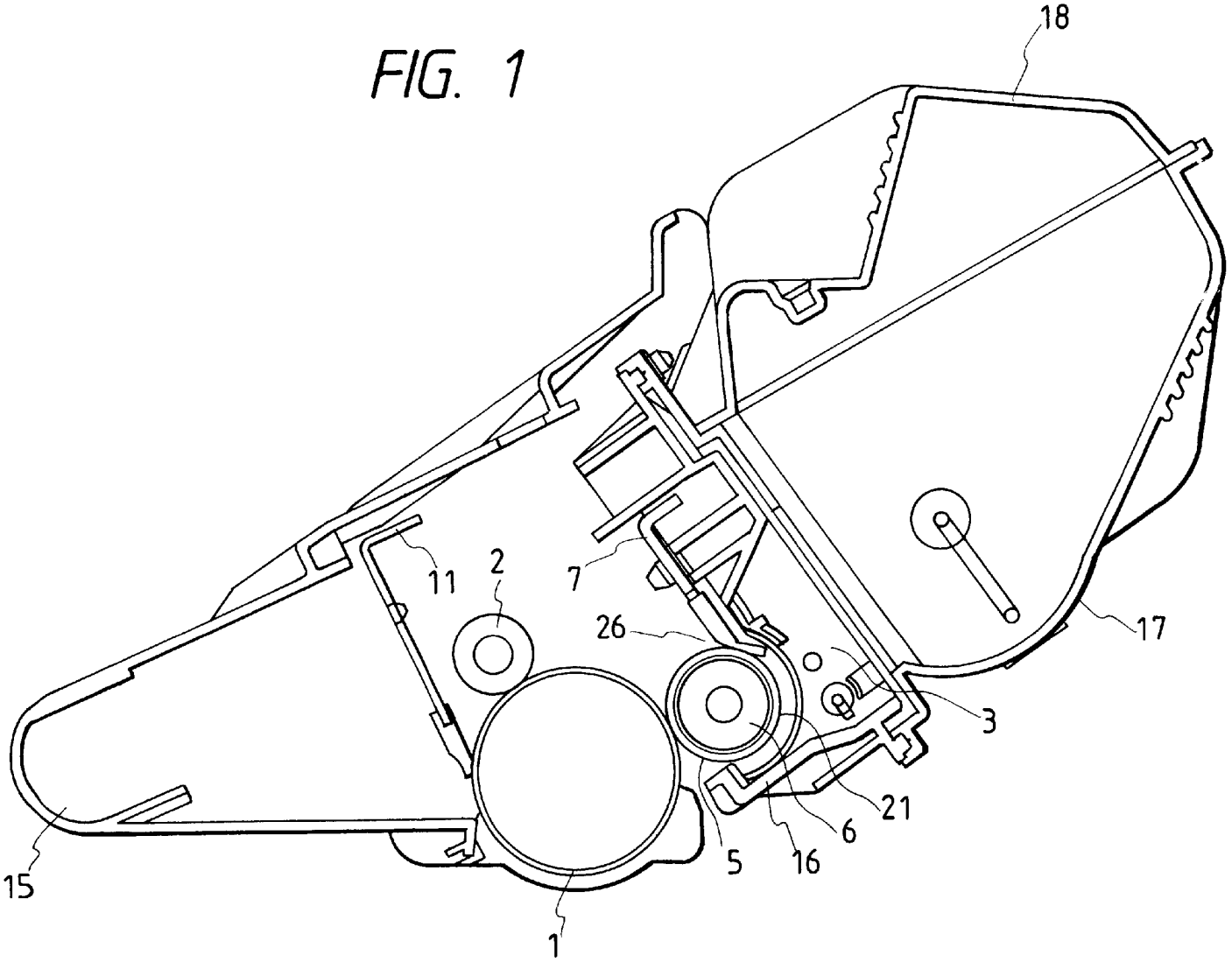
FIG. 1 is a sectional view showing a process cartridge having a developing device according to an embodiment of the present invention.

FIG. 1 is a sectional view showing a process cartridge which uses a developing device of an embodiment of the present invention and which is detachably mounted in an image forming apparatus body.

This process cartridge is a unit including at least a photosensitive member as an image holding member for holding an electrostatic image and a developing device for developing the electrostatic image on the photosensitive member.

As shown in FIG. 1, in the process cartridge according to the configuration of this embodiment, a developing means 4 including a charging means 2, a developer container 3, a developing sleeve 5 as a developer holding member, a developing blade 7, and a cleaning means 11 are arranged around a photosensitive drum 1. These components are covered with a housing constituted by frames 15, 16, 17, and 18, and are integrated into a cartridge. This cartridge is detachably mounted in an image forming apparatus body (not shown).

The developing sleeve 5 incorporates a magnetic roller 6, and is rotatably mounted on the developer container 3 through a sleeve bearing (not shown). Monocomponent magnetic toner as a developer supplied from the developer container 3 adheres to the surface of the developing sleeve 5 owing to the magnetic force of the magnetic roller 6, and is regulated by the developing blade 7 to a predetermined thickness. The resultant toner is brought to a position where it opposes a latent image on the photosensitive drum 1 upon pivotal movement of the developing sleeve 5. At this position, the toner adheres to the latent image to develop it.

Figure 2:
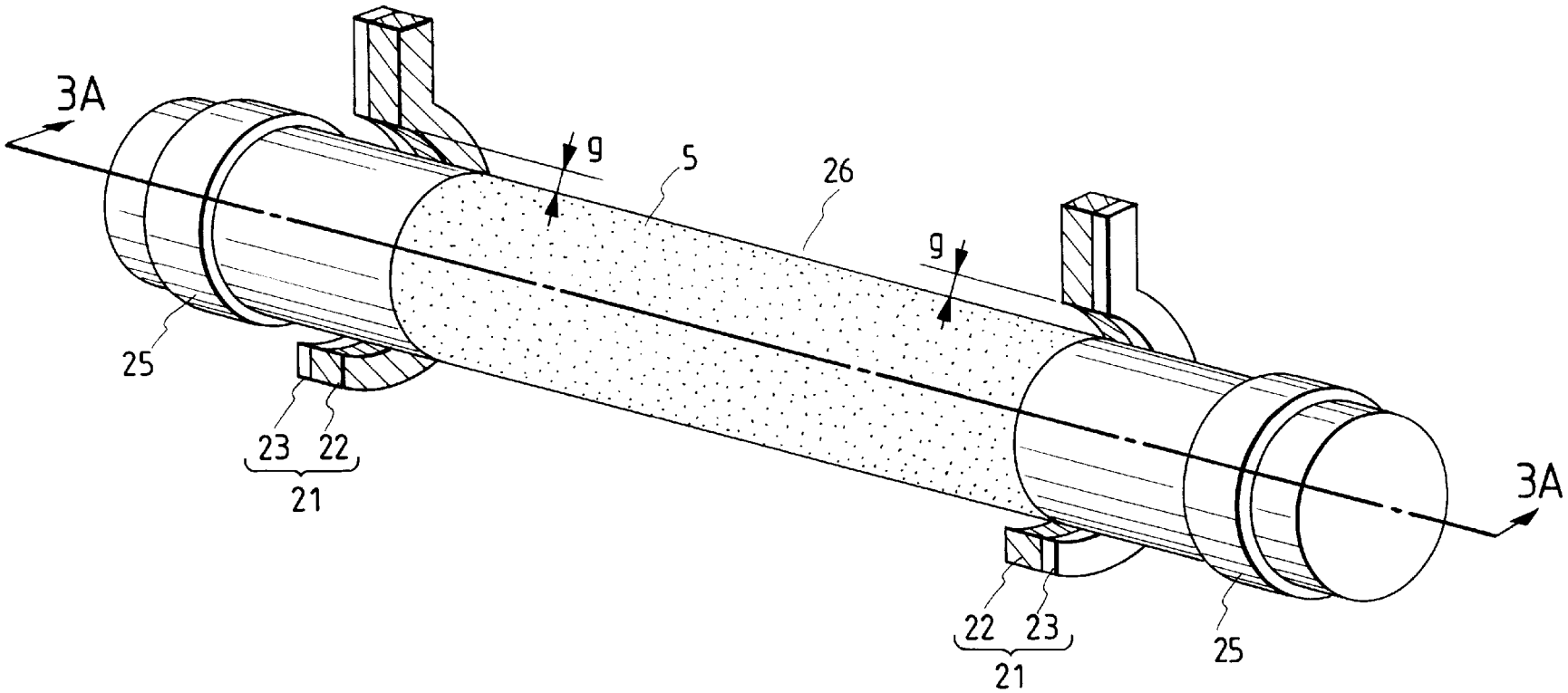
FIG. 2 is a partial perspective view of the developing device.

The developing means 4 has magnetic seal members 21 arranged along the outer surfaces of the two end portions of the developing sleeve 5. Each magnetic seal member 21 is mounted on the developer container 3 with a gap g being ensured between the magnetic seal member 21 and the outer surface of the developing sleeve 5. As shown in FIG. 2, the magnetic seal member 21 is formed by joining a magnetic plate (magnetic member) 23 to a side surface of a magnet 22 in its widthwise direction which coincides with the longitudinal direction of the developing sleeve 5.

Each magnetic seal member 21 in this embodiment will be described in detail.

The magnetic seal member 21 is constituted by the following two constituent elements: the magnet 22 which is an injection molded member which is 3 mm wide and made of a nylon binder containing an Nd-Fe-B magnetic powder; and the magnetic plate 23 which is a 1-mm thick iron member.

Figure 12:
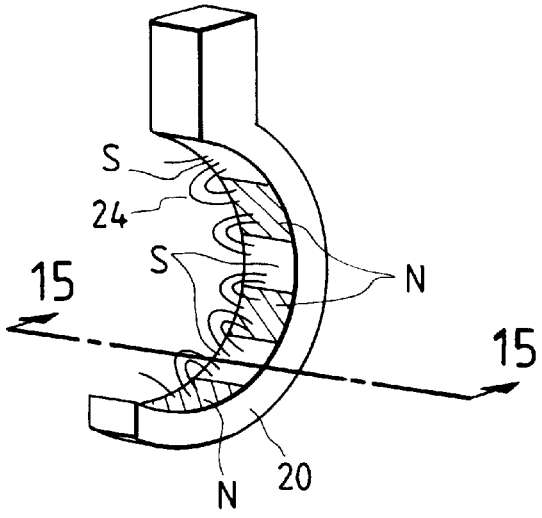
FIGS. 12, 13 and 14 are perspective views showing the magnetization patterns of a magnetic seal member.
Figure 13:
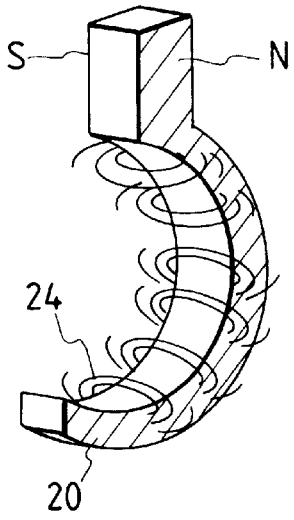
Figure 14:
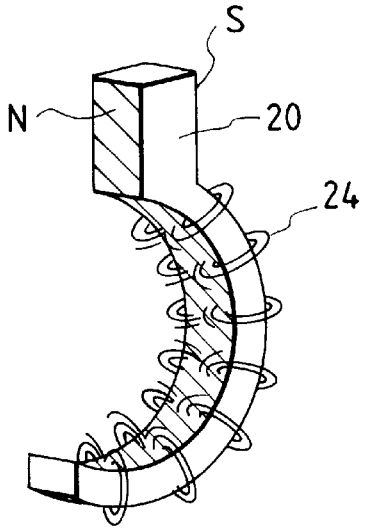

As shown in FIGS. 12, 13, and 14, the magnet 22 is magnetized in a plurality of sections along the circumferential direction of the developing sleeve. It is preferable that the magnet 22 be alternately magnetized to south and north poles, as in the magnetic seal member 20 shown in FIG. 12. Alternatively, the magnet 22 may be magnetized so as to have opposite polarities in the side surfaces thereof, as in the magnetic seal member 20 shown in FIG. 13. Alternatively, as in the magnetic seal member 20 shown in FIG. 14, the magnet 22 may be magnetized so as to have opposite polarities on the front side which opposes the developing sleeve 5, and the rear side.

The magnetic plate 23 is preferably made of a soft magnetic material, such as soft iron, silicon steel, or Permalloy, which has high magnetic susceptibility and small magnetic hysteresis loss.

As a method of joining the magnet 22 and the magnetic plate 23, insert molding of injection molding is used. Even if, however, these members are joined to each other by a double-coated adhesive tape or an adsorbing manner using only a magnetic force, the same effects to be described later can be obtained. The gap between the developing sleeve 5 and the magnetic seal member 21 is 0.1 to 0.7 mm, and the magnetic flux density on the surface of the developing sleeve 5, caused by the magnetic force of the magnetic seal member 21 is about 1,000 to 2,000 Gs. The magnets 22 and the magnetic plates 23 of the magnetic seal members 21 are positioned such that the magnets 22 are located on the near sides of an opening portion 26 (the middle portion of the developing sleeve 5 which is indicated by the dots in FIG. 2) of the developer container 3, and the magnetic plates 23 are located on the far sides of the opening portion 26 (the two longitudinal end portions of the developing sleeve 5 in FIG. 2).

Figure 3A:
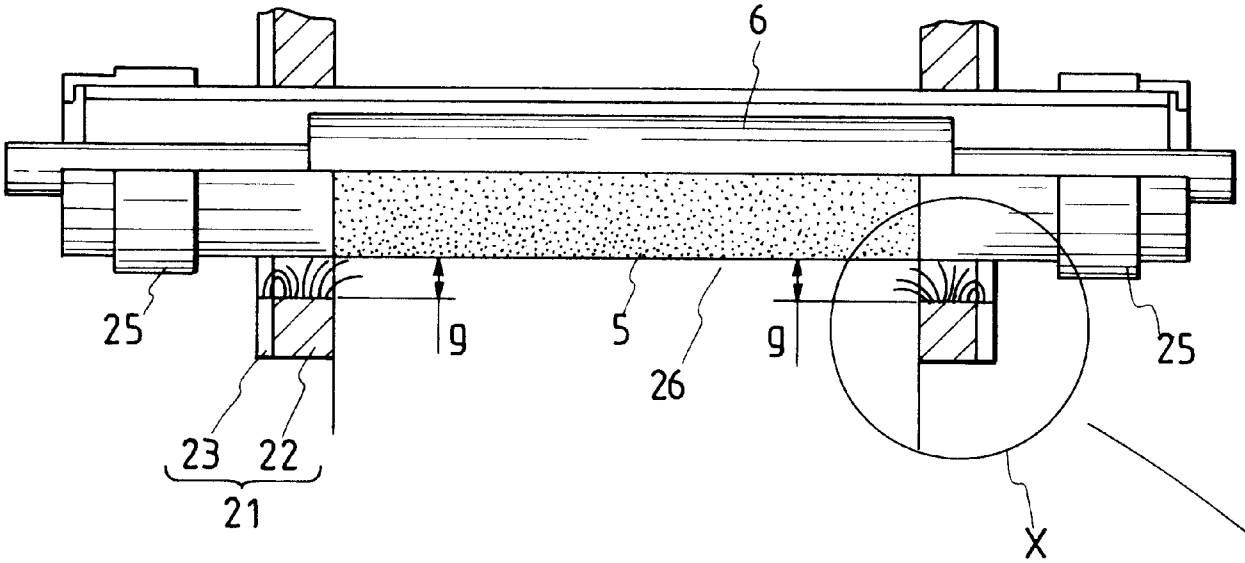
FIG. 3A is a sectional view taken along a line 3A—3A in FIG. 2.
Figure 3B:
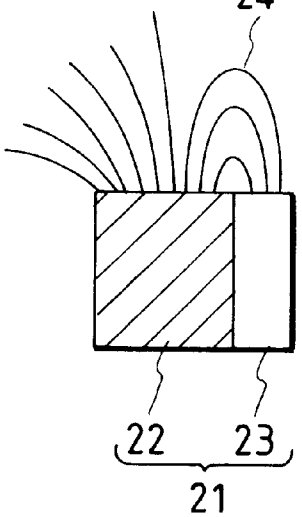
FIG. 3B is an enlarged view of a portion of FIG. 3A.
Figure 15:
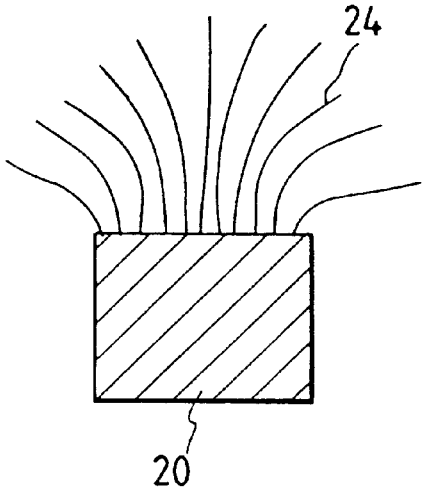
FIG. 15 is a view showing the magnetic lines of force along a cross-section taken along a line 15—15 in FIG. 12.
Figure 16:
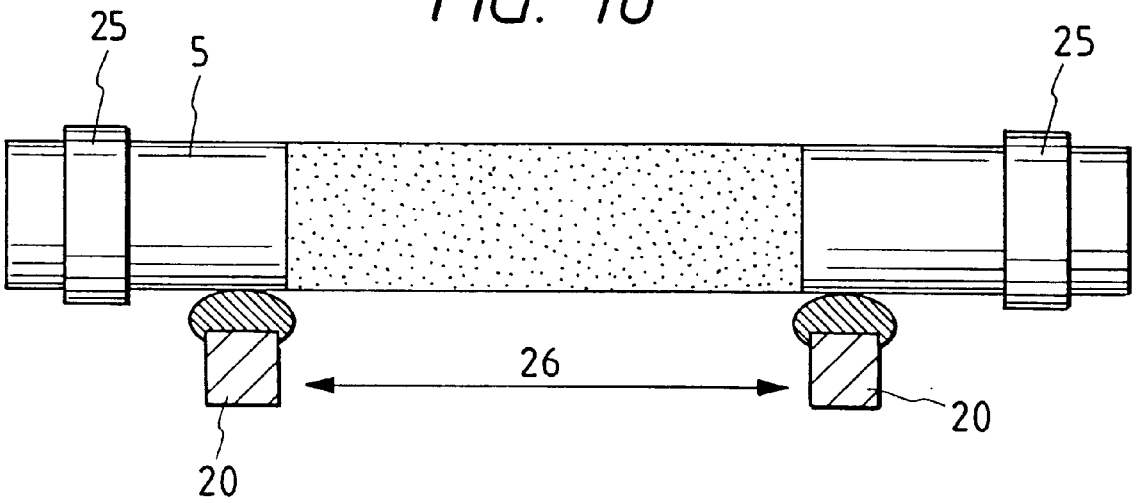
PRIOR ART FIG. 16
FIG. 16 is a view showing part of the developing device using magnetic seal members.

As described above, since the magnet 22 is located on the near side of the opening portion 26 of the developer container 3, and the magnetic plate 23 is located on the far side of the opening portion 26, magnetic lines of force 24 which run from the front side to the rear side of the magnetic seal member 21 are formed between the magnet 22 and the magnetic plate 23 to enter the magnetic plate 23 with high permeability, as indicated by FIG. 3B which is an enlarged view of a portion A in FIG. 3A. Unlike the prior art shown in FIGS. 15 and 16, almost no magnetic lines of force run beyond the width of the magnetic seal member 21.

Since the toner spreading along the magnetic lines of force 24 on the surface of each magnetic seal member 21 is not present outside the magnetic plate 23 on the magnetic plate 23 side (outside the opening portion 26), the toner does not come into contact with a spacer roller 25 upon rotation of the developing sleeve 5. For this reason, each spacer roller 25 can be placed near the side surface of the magnetic seal member 21. Apparently, therefore, the process cartridge can be reduced in size, and at the same time, the image forming apparatus body itself can be reduced in size. In addition, since the toner on each magnetic seal member 21 does not spread outside the opening portion 26 of the developer container 3 by the magnetic plate 23, the toner can be reliably held within the range in which the magnetic force on the surface of the magnetic seal member 21 is strong. Even if a shock or the like acts on the process cartridge when the user attaches/detaches it to/from the image forming apparatus, no toner leaks. That is, good sealing characteristics can be obtained.

Furthermore, since the magnetic plate 23 is joined to the side surface of each magnet 22, the magnetic lines of force 24 enter the magnetic plate 23, as described above. That is, the diverging magnetic lines of force are converged onto the magnetic plate 23. As a result, the magnetic flux density on the surface of the magnet 22 increases to attain a further improvement in sealing characteristics. Moreover, since compact, inexpensive magnets with small magnetic forces can be used when there is a margin in terms of sealing characteristics, a reduction in cost can be achieved.

<Second Embodiment>

The second embodiment of the present invention will be described next with reference to FIGS. 4, 5A and 5B.

The same reference numerals in FIGS. 4, 5A and 5B denote the same parts as in FIGS. 2, 3A and 3B, and a repetitive description thereof will be avoided; only the structure of a magnetic seal which is a characteristic feature of the second embodiment will be described below.

Figure 4:
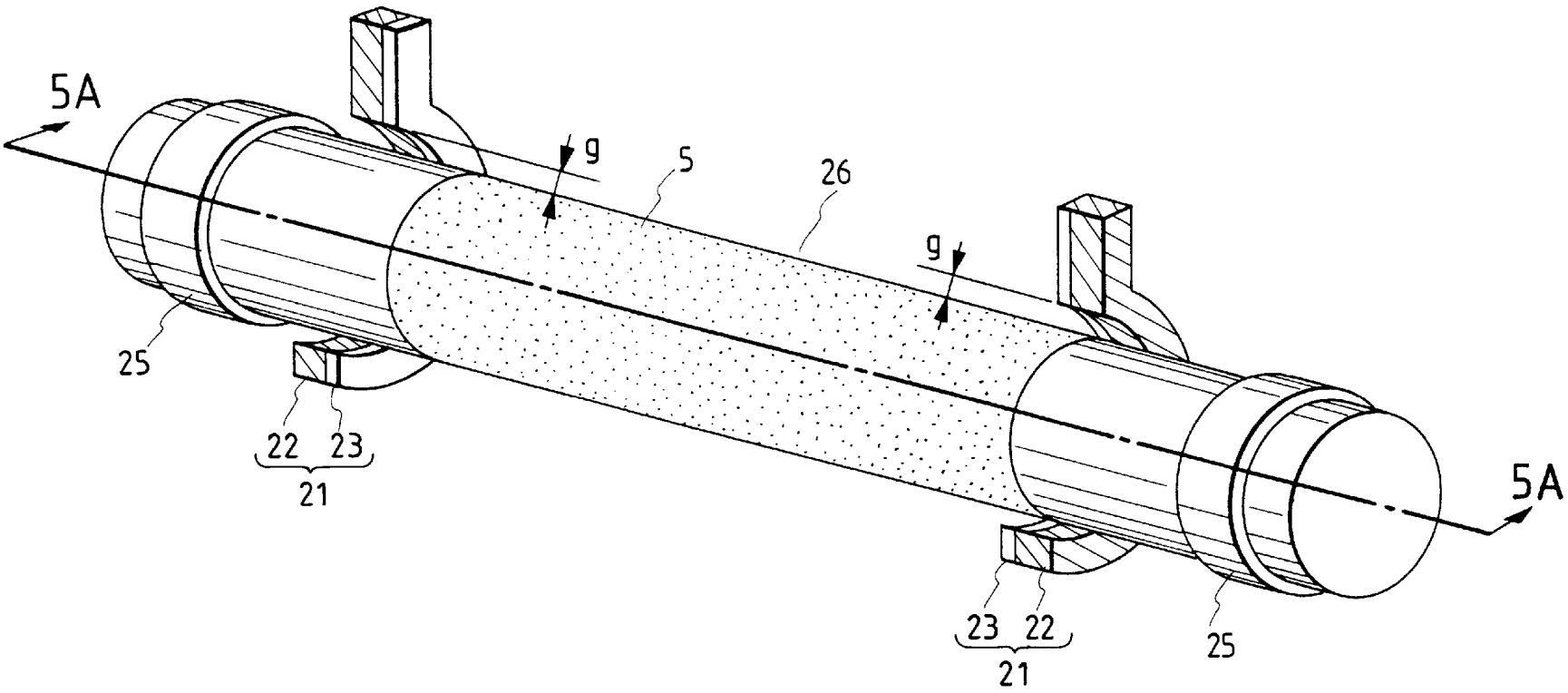
FIG. 4 is a partial perspective view of a developing device according to another embodiment of the present invention.

A magnet 22 and a magnetic plate 23 constituting a magnetic seal member 21 in this embodiment are positioned such that the magnetic plate 23 is located on the near side of the opening portion 26 of a developer container 3, and the magnet 22 is located on the far side of the opening portion 26, as shown in FIG. 4.

Each magnetic seal member 21 is located on the near side of the opening portion 26 to attain a reduction in the size of the device.

Figures 5A, 5B:
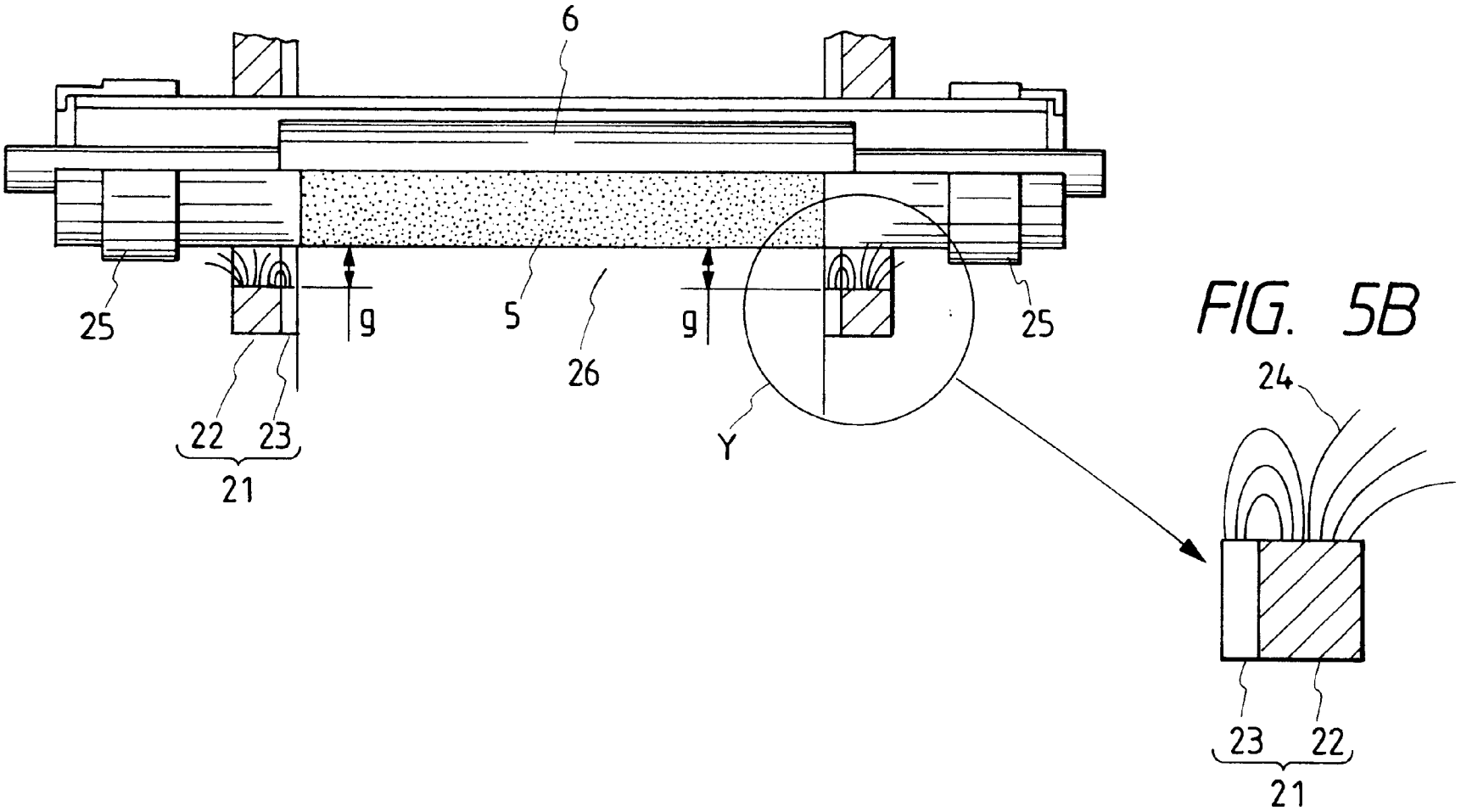
FIG. 5A is a sectional view taken along a line 5A—5A in FIG. 4.
FIG. 5B is an enlarged view of a portion of FIG. 5A.

As described above, since the magnet 22 is located on the far side of the opening portion 26 of the developer container 3, and the magnetic plate 23 is located on the near side of the opening portion 26, the magnetic seal member 21 delivers magnetic lines of force 24 between the magnet 22 and the magnetic plate 23, which enter the magnetic plate 23 with high permeability, as shown in FIGS. 5A and 5B. Unlike the prior art shown in FIGS. 15 and 16, therefore, no magnetic lines of force 24 run beyond the magnetic plate 23 in the width direction of the magnetic seal member 21.

The toner spreading along the magnetic lines of force 24 on the surface of the magnetic seal member 21 does not therefore spread to the magnetic plate 23 side, i.e., the inner wall of the opening portion 26. That is, the toner in the developer container does not spread in the axial direction of a developing sleeve 5 so as not to flow over the outer surface of the developing sleeve 5 along the magnetic lines of forces from each seal member constituted by the magnet. For this reason, the toner is not deposited on the inner wall of the opening portion 26 of the developer container 3 owing to the magnetic force of each seal member. This prevents a decrease in density due to a deficiency of the toner supply at an end portion of a toner image. Each seal member constituted by the magnet can be located far from the opening portion 26 to prevent a decrease in density. Alternatively, the problem associated with an increase in the longitudinal size of the device, which occurs, for example, when the width of the opening portion 26 becomes larger than the image area, can be solved.

Figure 6:
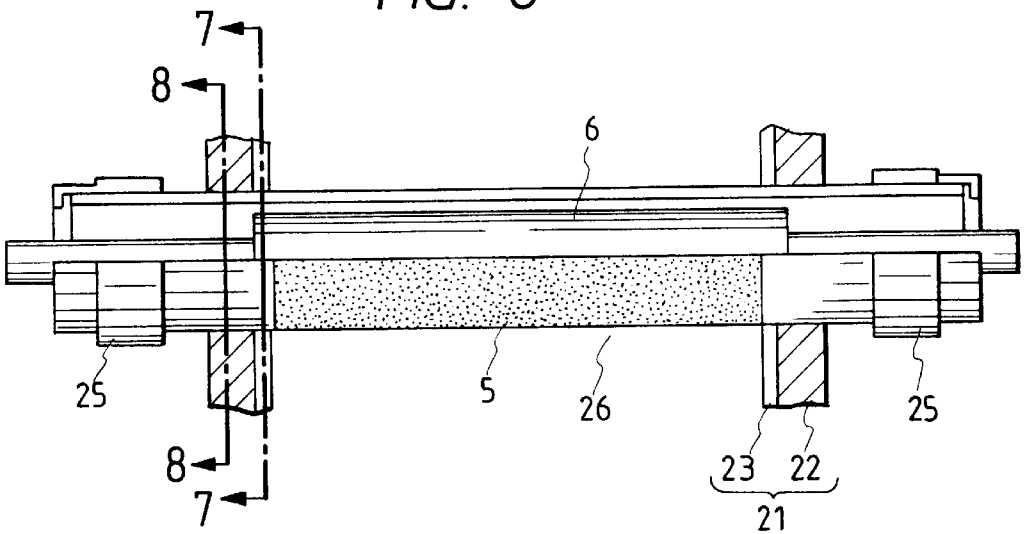
FIG. 6 is a sectional view taken along a line 5A—5A in FIG. 4.
Figure 8:
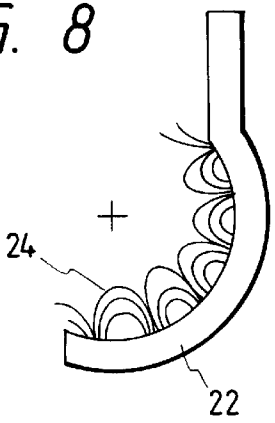
FIG. 8 is a sectional view taken along a line 8—8 in FIG. 6.
Figure 7:
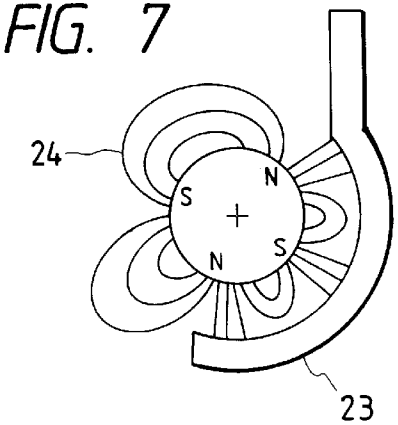
FIG. 7 is a sectional view taken along a line 7—7 in FIG. 6.
Figure 9:
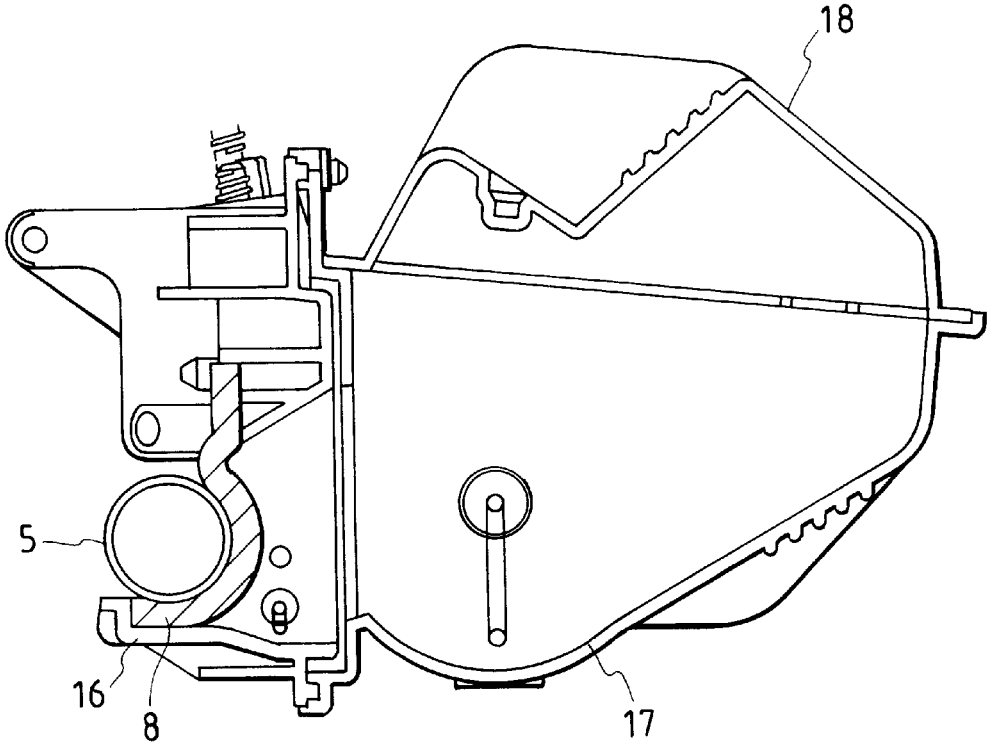
FIG. 9 is a sectional front view of the developing device portion of a conventional process cartridge.
Figure 10:
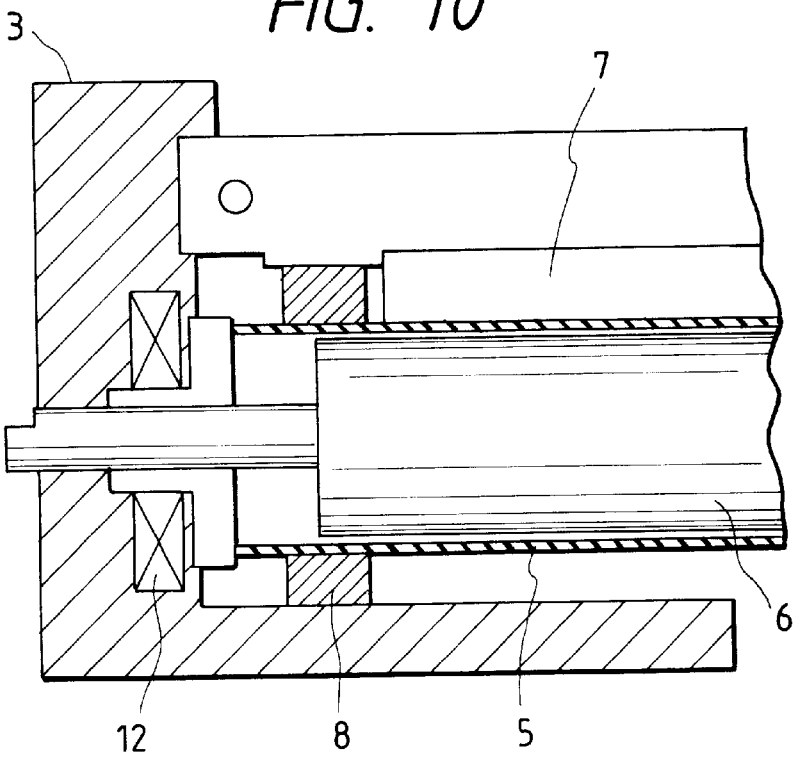
FIG. 10 is a sectional view showing the main part of the conventional developing device.
Figure 11:
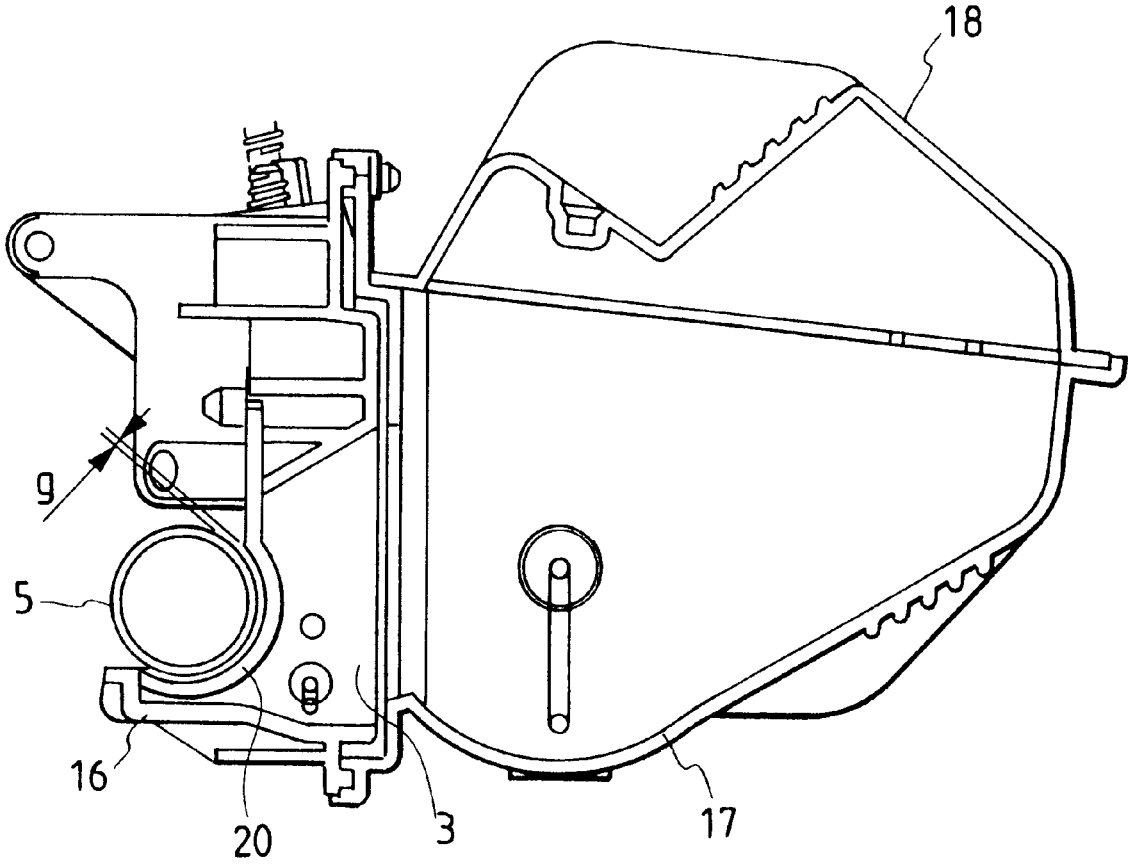
FIG. 11 is a sectional view showing a developing device using a magnetic seal.

In addition, a magnetic roller 6 is mounted in the developing sleeve 5, and the magnetic plates 23 are arranged to oppose the two ends of the magnetic roller 6. With this arrangement, at the position where the magnetic roller 6 and the magnetic plate 23 oppose each other, the magnetic lines of force 24 run as shown in FIG. 7 which is a sectional view taken along a line 7—7 in FIG. 6. FIG. 8 shows the magnetic lines of force 24 along a cross-section taken along a line 8—8 in FIG. 6. As shown in FIGS. 7 and 8, magnetic brushes are doubly formed in the longitudinal direction of the developing sleeve 5, i.e., the magnetic brush between the magnetic roller 6 and each magnetic plate 23 and the magnetic brush generated by the magnet of each magnetic seal member 21, thereby improving the sealing characteristics.

In addition, since the magnetic plates 23 are placed on the side surfaces of the magnets 22, the magnetic lines of force 24 from the magnets 22 enter the magnetic plates 23. For this reason, the magnetic lines of force 24 concentrate on the magnetic plate 23. Therefore, the magnetic flux density on the surface of each magnet 22 increases, and the magnetic force increases. Consequently, the sealing characteristics can be further improved.

Moreover, since compact, inexpensive magnets with small magnetic forces can be used when there is a margin in terms of sealing characteristics, a reduction in cost can be achieved.

The embodiments of the present invention have been described above, but the present invention is not limited these embodiments. Various changes and modifications of the embodiments can be made within the spirit and scope of the invention.

What is claimed is:

1. A developing device comprising:

a developer container containing magnetic particles;

a developer holding member provided at an opening portion of said developer container, said developer holding member rotating while holding a developer;

a magnetic field generating member placed in said developer holding member;

a magnet provided along a circumferential direction of said developer holding member so as to be opposed to the vicinity of an edge portion of said developer holding member; and wherein said magnet and said magnetic field generating member are provided so as to overlap each other in a longitudinal direction of said developer holding member, and a first magnetic brush is formed by a magnetic field generated between said magnet and said magnetic field generating member, a magnetic member magnetized by said magnet and provided so as to be adjacent to an outside of said magnet and to be opposed to said developer holding member in the longitudinal direction, wherein a second magnetic brush is formed by a magnetic field generated between said magnet and said magnetic member.

2. A developing device according to claim. 1, wherein said magnetic member has a plate-like shape and is placed so as to be substantially perpendicular to an axis of said developer holding member.

3. A developing device according to claim 2, wherein said magnetic member is placed along a side surface of said magnet.

4. A developing device according to claim 1, wherein said magnetic member is placed on an outside surface of said magnet in a longitudinal direction of said developer holding member.

5. A developing device according to claim 1, wherein said magnetic member is placed on an inside surface of said magnet in a longitudinal direction of said developer holding member.

6. A developing device according to claim 1, wherein the magnetic particles are a developer.

7. A developing device according to claim 6, wherein the developer is a monocomponent magnetic toner.

8. A developing device according to claim 1, wherein said magnetic member is made of iron.

9. A developing device according to claim 1, wherein said magnet is magnetized so as to have plural magnetic poles which have polarities different along the circumferential direction of said developer holding member.

10. A developing device according to claim 1, wherein each of said magnet and said magnetic member is provided singly in the longitudinal direction while being adjacent to the edge portion of said developer holding member.

11. A process cartridge detachably attachable to an image forming apparatus, comprising:

an image bearing member; and a developing device for developing an electrostatic image formed on said image bearing member by a developer, said developing device including:

a developer container containing magnetic particles;

a developer holding member provided at an opening portion of said developer container, said developer holding member rotating while holding a developer;

a magnetic field generating member placed in said developer holding member;

a magnet provided along a circumferential direction of said developer holding member so as to be opposed to the vicinity of an edge portion of said developer holding member;

wherein said magnet and said magnetic field generating member are provided so as to overlap each other in a longitudinal direction of said developer holding member, and a first magnetic brush is formed by a magnetic field generated between said magnet and said magnetic field generating member, and a magnetic member magnetized by said magnet provided so as to be adjacent to an outside of said magnet and to be opposed to said developer holding member in the longitudinal direction, wherein a second magnetic brush is formed by a magnetic field generated between said magnet and said magnetic member.

12. A process cartridge according to claim 11, wherein said magnetic member has a plate-like shape and is placed to be substantially perpendicular to an axis of said developer holding member.

13. A process cartridge according to claim 12, wherein said magnetic member is placed along a side surface of said magnet.

14. A process cartridge according to claim 11, wherein said magnetic member is placed on an outside surface of said magnet in a longitudinal direction of said developer holding member.

15. A process cartridge according to claim 11, wherein said magnetic member is placed on an inside surface of said magnet in a longitudinal direction of said developer holding member.

16. A process cartridge according to claim 11, wherein the magnetic particles are a developer.

17. A process cartridge according to claim 16, wherein the developer is a monocomponent magnetic toner.

18. A process cartridge according to claim 11, wherein said magnetic member is made of iron.

19. A process cartridge according to claim 11, wherein said magnet is magnetized so as to have plural magnetic poles which have polarities different along the circumferential direction of said developer holding member.

20. A process cartridge according to claim 11, wherein each of said magnet and said magnetic member is provided singly in the longitudinal direction while being adjacent to the edge portion of said developer holding member.

21. A conveying device for conveying magnetic particles, comprising:

a container containing magnetic particles;

a magnetic particles holding member provided at an opening portion of said container, said magnetic particles holding member rotating while holding the magnetic particles;

a magnetic field generating member placed in said magnetic particles holding member;

a magnet provided along a circumferential direction of said magnetic particles holding member so as to be opposed to the vicinity of an edge portion of said magnetic particles holding member;

wherein said magnet and said magnetic field generating member are provided so as to overlap each other in a longitudinal direction of said magnetic particles holding member, and a first magnetic brush is formed by a magnetic field generated between said magnet and said magnetic field generating member, and a magnetic member magnetized by said magnet provided so as to be adjacent to an outside of said magnet and to be opposed to said magnetic particles holding member in the longitudinal direction;

wherein a second magnetic brush is formed by a magnetic field generated between said magnet and said magnetic member.

22. A developing device comprising:

a developer container containing magnetic particles;

a developer holding member provided at an opening portion of said developer container, said developer holding member rotating while holding a developer;

a magnetic field generating member placed in said developer holding member;

a magnet provided along a circumferential direction of said developer holding member so as to be opposed to the vicinity of an edge portion of said developer holding member; and wherein said magnet and said magnetic field generating member are provided so as to overlap each other in a longitudinal direction of said developer holding member, and a magnetic member magnetized by said magnet provided so as to be adjacent to an outside of said magnet and to be opposed to said developer holding member in the longitudinal direction, wherein a magnetic brush is formed by a magnetic operation between said magnet and said magnetic field generating member and a magnetic operation between said magnet and said magnetic member.

23. A device according to claim 22, wherein said magnetic member has a plate-like shape and is placed so as to be substantially perpendicular to an axis of said developer holding member.

24. A device according to claim 23, wherein said magnetic member is placed along a side surface of said magnet.

25. A device according to claim 22, wherein the magnetic particles are a developer.

26. A device according to claim 25, wherein the developer is a monocomponent magnetic toner.

27. A device according to claim 22, wherein said magnet is magnetized so as to have plural magnetic poles which have polarities different along the circumferential direction of said developer holding member.

28. A device according to claim 22, wherein each of said magnet and said magnetic member is provided singly in the longitudinal direction while being adjacent to the edge portion of said developing holding member.

29. A process cartridge detachably attachable to an image forming apparatus, comprising:

an image bearing member; and a developing device for developing an electrostatic image formed on said image bearing member by a developer, said developer including:

a developer container containing magnetic particles;

a developer holding member provided at an opening portion of said developer container, said developer holding member rotating while holding a developer;

a magnetic field generating member placed in said developer holding member;

a magnet provided along a circumferential direction of said developer holding member so as to be opposed to the vicinity of an edge portion of said developer holding member; and wherein said magnet and said magnetic field generating member are provided so as to overlap each other in a longitudinal direction of said developer holding member, and a magnetic member magnetized by said magnet provided so as to be adjacent to an outside of said magnet and to be opposed to said developer holding member in the longitudinal direction, wherein a magnetic brush is formed by a magnetic operation between said magnet and said magnetic field generating member and a magnetic operation between said magnet and said magnetic member.

30. A conveying device for conveying magnetic particles, comprising:

a container containing magnetic particles;

a magnetic particles holding member provided at an opening portion of said container, said magnetic particles holding member rotating while holding the magnetic particles;

a magnetic field generating member placed in said magnetic particles holding member;

a magnet provided along a circumferential direction of said magnetic particles holding member so as to be opposed to the vicinity of an edge portion of said magnetic particles holding member; and wherein said magnet and said magnetic field generating member are provided so as to overlap each other in a longitudinal direction of said magnetic particles holding member, and a magnetic member magnetized by said magnet provided so as to be adjacent to an outside of said magnet and to be opposed to said magnetic particles holding member in the longitudinal direction, wherein a magnetic brush is formed by a magnetic operation between said magnet and said magnetic field generating member and a magnetic operation between said magnet and said magnetic member.

* * * * *

UNITED STATES PATENT AND TRADEMARK OFFICE

CERTIFICATE OF CORRECTION

PATENT NO. : 6,160,976
DATED : December 12, 2000
INVENTOR(S) : Toshiyuki Karakama et al.

It is certified that error appears in the above-identified patent and that said Letters Patent is hereby corrected as shown below:

Title page,
Item [56], References Cited, U.S. PATENT DOCUMENTS insert the following:

| | | |
|---|---|---|
| -- 5,267,007 | 11/1993 | Watanabe et al. |
| 5,450,169 | 9/1995 | Hart et al. |
| 5,552,864 | 9/1996 | Malicki et al. -- |

Item [56], References Cited, U.S. FOREIGN PATENT DOCUMENTS insert the following:

| | | |
|---|---|---|
| -- 03-013976 | 1/1991 | Japan |
| 04-069691 | 3/1992 | Japan |
| 07-281528 | 10/1995 | Japan |
| 09-026702 | 1/1997 | Japan --. |

Signed and Sealed this

Sixteenth Day of April, 2002

*Attest:*

*Attesting Officer*

JAMES E. ROGAN
*Director of the United States Patent and Trademark Office*